US008280293B2

(12) United States Patent
Shintani et al.

(10) Patent No.: US 8,280,293 B2
(45) Date of Patent: Oct. 2, 2012

(54) IMAGE FORMING APPARATUS

(75) Inventors: Takeshi Shintani, Kanagawa (JP); Nobuo Kuwabara, Kanagawa (JP); Satoshi Hatori, Kanagawa (JP); Daisuke Tomita, Tokyo (JP); Akio Kosuge, Kanagawa (JP); Shinichi Kawahara, Tokyo (JP); Shinya Karasawa, Kanagawa (JP); Takaya Muraishi, Kanagawa (JP); Yasushi Akiba, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 281 days.

(21) Appl. No.: 12/805,171

(22) Filed: Jul. 15, 2010

(65) Prior Publication Data

US 2011/0026992 A1 Feb. 3, 2011

(30) Foreign Application Priority Data

Jul. 31, 2009 (JP) ..... 2009-179259
Feb. 1, 2010 (JP) ..... 2010-020539

(51) Int. Cl.
*G03G 21/00* (2006.01)

(52) U.S. Cl. ..... 399/346; 399/123; 399/350

(58) Field of Classification Search ..... 399/71, 399/110, 123, 343–351
See application file for complete search history.

(56) References Cited

U.S. PATENT DOCUMENTS 4,247,196 A * 1/1981 Ogawa et al. ..... 399/351
7,493,075 B2 2/2009 Shintani et al.
7,583,925 B2 9/2009 Karasawa
7,680,446 B2 3/2010 Shintani et al.
7,899,382 B2 3/2011 Hozumi et al.
8,027,628 B2 * 9/2011 Watanabe et al. ..... 399/350
2007/0154246 A1 7/2007 Shintani et al.
2008/0069614 A1 3/2008 Shintani et al.
2008/0069615 A1 3/2008 Shintani et al.
2008/0118285 A1 5/2008 Karasawa
2009/0103944 A1 4/2009 Shintani et al.
2009/0120356 A1 5/2009 Karasawa et al.
2009/0142115 A1 6/2009 Muraishi et al.
2009/0241830 A1 10/2009 Koike et al.
2010/0021205 A1 1/2010 Honjoh et al.

FOREIGN PATENT DOCUMENTS

CN 101303563 A 11/2008
JP 06-195010 7/1994
JP 2000-330443 11/2000
JP 2002-268487 9/2002
JP 2007-264347 10/2007
JP 4027011 10/2007
JP 2008-276125 11/2008
JP 2009-048107 3/2009

OTHER PUBLICATIONS

Abstract of JP 2001-175047 published on Jun. 29, 2001.
Chinese Office Action, dated Jan. 11, 2012, for Application 201010243789.6.

* cited by examiner

*Primary Examiner* — Hoan Tran
(74) *Attorney, Agent, or Firm* — Harness, Dickey & Pierce, P.L.C.

(57) ABSTRACT

In an image forming apparatus including a plurality of image forming devices, a first image forming device in which a leveling blade that functions as a lubricant leveling blade is easily worn away over time uses an obtuse-angle blade as a first leveling blade, and a second image forming device being other image forming device among the plurality of image forming devices uses a right-angle blade as a second leveling blade.

18 Claims, 3 Drawing Sheets

IMAGE FORMING APPARATUS

CROSS-REFERENCE TO RELATED APPLICATIONS

The present application claims priority to and incorporates by reference the entire contents of Japanese Patent Application No. 2009-179259 filed in Japan on Jul. 31, 2009 and Japanese Patent Application No. 2010-020539 filed in Japan on Feb. 1, 2010. The present application incorporates by reference the entire contents of Japanese Patent Application No. 2009-063679 filed in Japan on Mar. 16, 2009.

BACKGROUND OF THE INVENTION

1. Field of the Invention

The present invention relates to an image forming apparatus such as a copier, a facsimile machine, and a printer.

2. Description of the Related Art

An electrophotographic image forming apparatus generally includes a cleaning device that cleans a surface of an image carrier by removing residual toner remained on the surface of the image carrier after an image transfer process so that the surface of the image carrier can repeatedly be used for image formation. A cleaning device having a cleaning blade formed of an elastic member made of polyurethane rubber and the like is generally used as the above cleaning device because it has a simple structure and good toner removal capability. Furthermore, an image forming apparatus that includes a lubricant supply device has been proposed, in which the lubricant supply device supplies lubricant made of fatty acid metal salt and the like to the surface of the image carrier in order to reduce a coefficient of friction between the above-mentioned cleaning blade and the surface of the image carrier. In such an image forming apparatus, when the amount of the lubricant supplied to the surface of the image carrier is too small, the coefficient of friction cannot sufficiently be reduced, so that failures due to a high coefficient of friction (e.g., cleaning blade burr or shortening of the lifetime of the image carrier) cannot fully be prevented. On the other hand, when the amount of the lubricant supplied to the surface of the image carrier is too large, an amount of the lubricant that gets attached to various members and devices placed around the image carrier increases, so that failures due to the attached lubricant (e.g., occurrence of abnormal images due to the lubricant attached to a charging member and a developer holding member) markedly increase. Therefore, in the image forming apparatus that includes a mechanism for supplying lubricant to the surface of the image carrier, it is important to perform control to optimize the amount of the lubricant to be supplied to the surface of the image carrier.

Some of such image forming apparatuses as described above are configured to supply lubricant to the surface of the image carrier at a position upstream of a contact portion of the cleaning blade and the surface of the image carrier in a surface movement direction of the image carrier. In this configuration, the cleaning blade also functions to spread and level out the lubricant supplied to the surface of the image carrier. Therefore, it is possible to level out the lubricant supplied to the surface of the image carrier to some extent without providing a lubricant leveling member for leveling out the lubricant in addition to the cleaning blade. However, in this configuration, because the lubricant slips into the contact portion of the cleaning blade together with residual toner, the amount of the lubricant may vary between an area where the residual toner is present and an area where the residual toner is not present. Therefore, the lubricant cannot fully be leveled out.

In this case, the amount of the lubricant may be too large or too small in some portions on the surface of the image carrier, so that the above-mentioned failures may occur locally. Furthermore, in the above-mentioned configuration, some lubricant is attached to the residual toner and removed together with the toner. In this case, it is difficult to accurately recognize the amount of the lubricant to be removed, so that it is difficult to control the supply amount and the consumption amount of the lubricant. As a result, the above-mentioned failures are likely to occur.

On the other hand, Japanese Patent Application Laid-open No. 2000-330443 discloses an image forming apparatus that includes a lubricant supply means arranged downstream of a contact portion of a cleaning blade and an image carrier in a surface movement direction of the image carrier, and also includes a lubricant leveling blade arranged downstream of the lubricant supply means and used for leveling out the lubricant. In this image forming apparatus, because the surface of the image carrier is already cleaned when the lubricant is to be supplied thereto, the lubricant supplied to the surface of the image carrier can fully be leveled out by the lubricant leveling blade. Furthermore, it is possible to prevent the lubricant from getting attached to toner and removed together with the toner. Therefore, it is possible to easily control the supply amount and the consumption amount of the lubricant. The lubricant leveling blade disclosed in Japanese Patent Application Laid-open No. 2000-330443 is arranged such that a ridge portion of the lubricant leveling blade comes into contact with the surface of the image carrier so that the ridge portion intersects with the surface movement direction of the surface of the image carrier in order to level out the lubricant supplied to the surface of the image carrier. Thus, this lubricant leveling blade is a right-angle blade in which a blade corner portion angle formed by two planes, one of which faces the surface of the image carrier on the upstream side and the other of which faces the surface of the image carrier on the downstream side in the surface movement direction of the surface of the image carrier across the ridge portion being in contact with the surface of the image carrier, is set to a right angle.

In recent years, a demand for long-term maintenance free operations of image forming apparatuses has been growing, and it has been desired to maintain functions of the lubricant leveling blade at a constant level over a long period of time from the initial time. To maintain the functions of the lubricant leveling blade, it is necessary to reduce the amount of abrasion that occurs on the ridge portion of the lubricant leveling blade being in contact with the surface of the image carrier over time.

Japanese Patent Application Laid-open No. 2008-276125 discloses a technology for reducing the amount of abrasion that occurs on the ridge portion being in contact with the surface of the image carrier over time by using, as the lubricant leveling blade, an obtuse-angle blade in which the blade corner portion angle formed by two planes, one of which faces the surface of the image carrier on the upstream side and the other of which faces the surface of the image carrier on the downstream side in the surface movement direction of the surface of the image carrier across the ridge portion being in contact with the surface of the image carrier, is set to an obtuse angle.

However, although the amount of abrasion that occurs on the ridge portion being in contact with the surface of the image carrier over time can be reduced by using the obtuse-angle blade as the lubricant leveling blade, the process cost of the obtuse-angle blade is higher than that of the right-angle blade. Therefore, if the obtuse-angle blade is used as a lubricant leveling blade in each image forming device of an image forming apparatus that includes a plurality of image forming devices like a full-color image forming apparatus that uses four colors, manufacturing costs increase because of increase in the process cost of the lubricant leveling blades by the number of the image forming devices. In view of this, it is desirable to decrease the number of image forming devices that use the obtuse-angle blades as the lubricant leveling blades as much as possible.

Incidentally, a blade member, which can reduce the amount of abrasion that occurs on the ridge portion being in contact with the surface of the image carrier over time when it is configured as the obtuse-angle blade, may be applied to not only the lubricant leveling blade but also any blade members.

SUMMARY OF THE INVENTION

It is an object of the present invention to at least partially solve the problems in the conventional technology.

According to an aspect of the present invention, there is provided an image forming apparatus that includes a plurality of image forming devices. Each of the image forming devices includes an image carrier that carries a toner image and a surface of which is moved; a toner removing unit that removes residual toner remained on the surface of the image carrier after the toner image is transferred to a transfer member by a transferring unit; a lubricant supply mechanism that supplies lubricant to the surface of the image carrier after the toner removing unit removes the residual toner; and a lubricant leveling blade that is arranged such that a ridge portion of the lubricant leveling blade comes into contact with the surface of the image carrier so that the ridge portion intersects with a surface movement direction of the surface of the image carrier, and that levels out the lubricant supplied to the surface of the image carrier. An image forming device in which the lubricant leveling blade is more easily worn away over time than the lubricant leveling blades of the other image forming devices among the plurality of image forming devices includes, as the lubricant leveling blade, an obtuse-angle blade in which a blade corner portion angle formed by two planes, one of which faces the surface of the image carrier on an upstream side and the other of which faces the surface of the image carrier on a downstream side in a surface movement direction of the surface of the image carrier across the ridge portion, is set to an obtuse-angle. Each image forming device other than the image forming device having the obtuse-angle blade includes, as the lubricant leveling blade, a right-angle blade in which the blade corner portion angle formed by two planes forming the ridge portion is set to a substantially right angle.

According to another aspect of the present invention, there is provided an image forming apparatus that includes a plurality of image forming devices. Each of the image forming devices includes an image carrier that carries a toner image and a surface of which is moved; and a blade member arranged such that a ridge portion of the blade member comes into contact with the surface of the image carrier so that the ridge portion intersects with a surface movement direction of the surface of the image carrier. An image forming device in which the blade member is more easily worn away over time than the blade members of other image forming devices among the plurality of image forming devices includes, as the blade member, an obtuse-angle blade in which a blade corner portion angle formed by two planes, one of which faces the surface of the image carrier on an upstream side and the other of which faces the surface of the image carrier on a downstream side in the surface movement direction of the surface of the image carrier across the ridge portion, is set to an obtuse angle. Each image forming device other than the image forming device having the obtuse-angle blade includes, as the blade member, a right-angle blade in which the blade corner portion angle formed by two planes forming the ridge portion is set to a substantially right angle.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings. In the embodiments, the present invention is applied to a tandem-type color image forming apparatus.

Figure 2:
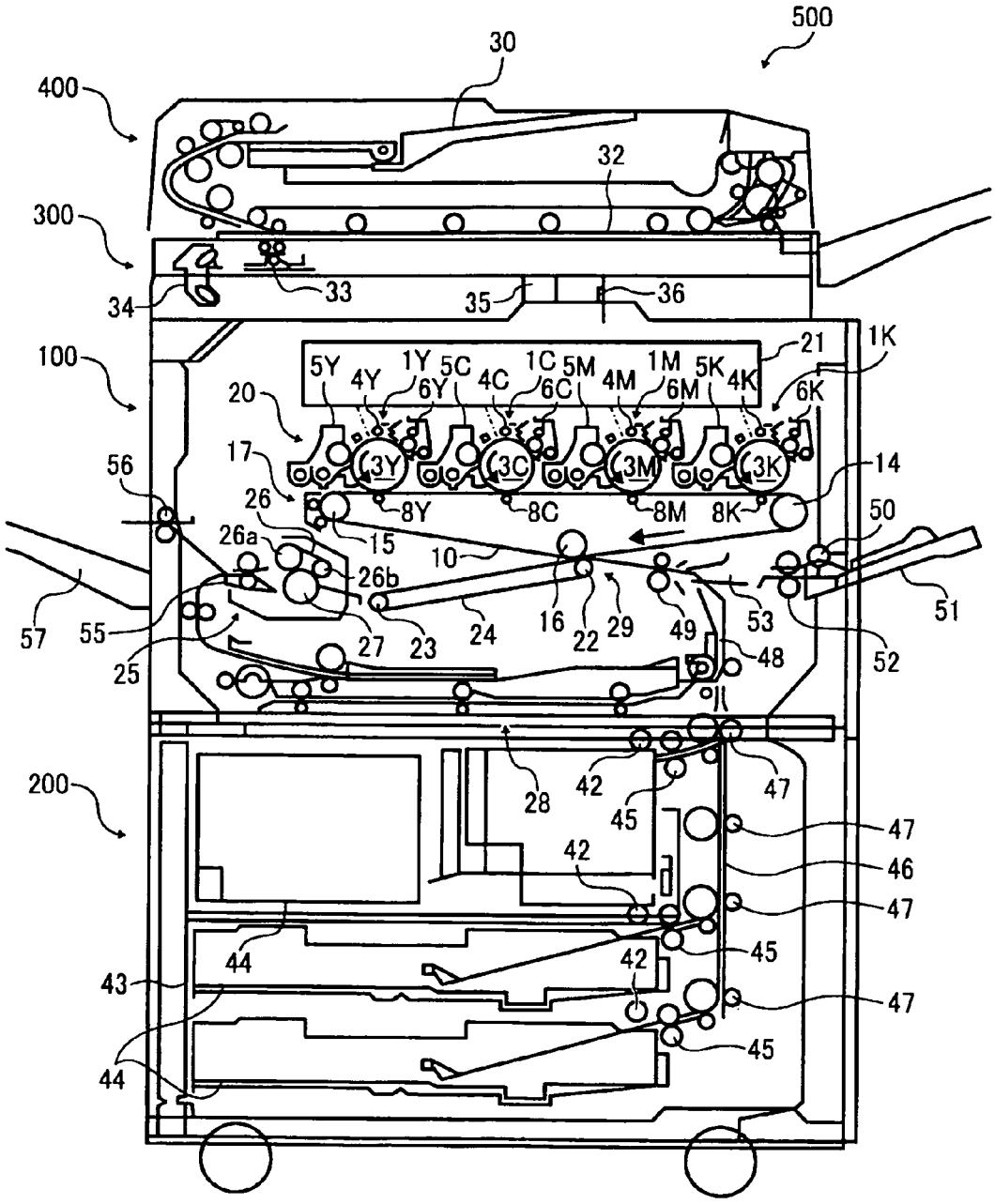
FIG. 2 is a schematic diagram of a configuration of a copier according to the embodiment.

FIG. 2 is a schematic diagram of a configuration of a copier (hereinafter, referred to as a copier 500) as an image forming apparatus according to the embodiment. The copier 500 includes a copier main body (hereinafter, referred to as a printer unit 100), a paper feed table (hereinafter, referred to as a paper feed unit 200), a scanner (hereinafter, referred to as a scanner unit 300) mounted on the printer unit 100, and an automatic document feeder (ADF) (hereinafter, referred to as an original conveying unit 400) mounted on the scanner unit 300. The copier 500 also includes a control unit (not shown) for controlling operations of each device in the copier 500.

The printer unit 100 includes an intermediate transfer belt 10 as an intermediate transfer member in the center thereof. The intermediate transfer belt 10 is extended around a first support roller 14, a second support roller 15, and a third support roller 16, and the surface of the intermediate transfer belt 10 is able to move clockwise in the figure. Four photosensitive elements 3 (K, M, C, Y) as latent-image carriers, each of which carries a monochrome toner image for black, magenta, cyan, or yellow on the surface thereof, are arranged to face the intermediate transfer belt 10.

Around the photosensitive elements 3 (K, M, C, Y) are respectively arranged charging devices 4 (K, M, C, Y) as charging means that uniformly charge the surfaces of the photosensitive elements 3 (K, M, C, Y), and developing devices 5 (K, M, C, Y) as developing means for forming toner images. Furthermore, photosensitive-element cleaning devices 6 (K, M, C, Y) that remove untransferred residual toner remained on the surfaces of the photosensitive elements 3 (K, M, C, Y) are also arranged around the photosensitive elements 3 (K, M, C, Y), respectively. The photosensitive-element cleaning devices 6 (K, M, C, Y) include respective lubricant supply mechanisms that supply lubricant to the surfaces of the photosensitive elements 3 (K, M, C, Y) and respective lubricant leveling blades that level out the supplied lubricant.

The photosensitive elements 3 (K, M, C, Y), the developing devices 5 (K, M, C, Y), the charging devices 4 (K, M, C, Y), and the photosensitive-element cleaning devices 6 (K, M, C, Y) constitute image forming devices 1 (K, M, C, Y) that function as image forming units, respectively. Furthermore, a tandem-type image forming unit 20 is formed by arranging the four image forming devices 1 (K, M, C, Y) in sequence in a horizontal direction.

Each of the charging devices 4 (K, M, C, Y) according to the embodiment is formed of a noncontact charging roller in the form of a roller, and applies an AC (alternating current) voltage and a DC (direct current) voltage to thereby uniformly charge a corresponding one of the photosensitive elements 3 (K, M, C, Y). The charging devices 4 (K, M, C, Y) are not limited to the noncontact charging rollers, and may be formed of, for example, noncontact chargers or contact charging rollers.

A belt cleaning device 17, which removes residual toner remained on the intermediate transfer belt 10 after a toner image is transferred onto a transfer paper being a recording medium, is arranged to face the second support roller 15 across the intermediate transfer belt 10. The printer unit 100 includes an exposing device 21 arranged above the tandem-type image forming unit 20.

Primary transfer rollers 8 (K, M, C, Y) are arranged on the inner side of the intermediate transfer belt 10 so as to face the photosensitive elements 3 (K, M, C, Y), respectively, across the intermediate transfer belt 10. The primary transfer rollers 8 (K, M, C, Y) are arranged to be pressed to the photosensitive elements 3 (K, M, C, Y), respectively, across the intermediate transfer belt 10, so that primary transfer portions are formed.

On the other hand, a secondary transfer device 29 is arranged on the opposite side of the tandem-type image forming unit 20 across the intermediate transfer belt 10. The secondary transfer device 29 is structured such that a secondary transfer belt 24 is extended between a secondary transfer roller 22 and a secondary-transfer-belt extension roller 23. In the secondary transfer device 29, the secondary transfer belt 24 is pressed to the third support roller 16 via the intermediate transfer belt 10 at a position supported by the secondary transfer roller 22. The secondary transfer device 29 is arranged so that a secondary transfer nip portion as a secondary transfer portion is formed between the secondary transfer belt 24 and the intermediate transfer belt 10.

A fixing device 25 that fixes a transferred image to a transfer paper is arranged on the left side of the secondary transfer device 29 in the figure. The fixing device 25 is structured such that a pressing roller 27 is pressed to a fixing belt 26 being an endless belt extended between a heating roller 26*a* accommodating a heat source and a fixing roller 26*b*. The secondary transfer device 29 mentioned above is equipped with a transfer-paper conveying function for conveying, to the fixing device 25, a transfer paper onto which a toner image has been transferred at the secondary transfer nip portion. It is possible to arrange a transfer roller or a noncontact charger as the secondary transfer device 29. However, in this case, it is difficult to realize the transfer-paper conveying function by the secondary transfer device 29.

A transfer-paper reversing device 28 that reverses a transfer paper so as to record images on both sides of the transfer paper is arranged below the secondary transfer device 29 and the fixing device 25 and parallel to the tandem-type image forming unit 20 mentioned above. Therefore, after an image is fixed to one side of a transfer paper, a conveying direction of the transfer paper is changed to the transfer-paper reversing device 28 side by a switching claw 55, and the transfer paper is reversed by the transfer-paper reversing device 28, conveyed to the secondary transfer nip portion again, subjected to transfer of a toner image, and discharged onto a discharge tray 57.

The scanner unit 300 reads image information of an original placed on a contact glass 32 by using a read sensor 36, and sends the read image information to the above-mentioned control unit (not shown).

The control unit (not shown) controls a laser, an LED, and the like (not shown) arranged in the exposing device 21 of the printer unit 100 to apply laser writing light L toward the photosensitive elements 3 based on the above-mentioned image information received from the scanner unit 300. Because of this irradiation, electrostatic latent images are formed on the surfaces of the photosensitive elements 3. The electrostatic latent images are developed into toner images by a predetermined developing process.

The paper feed unit 200 includes multi-stage paper-feed cassettes 44 accommodated in a paper bank 43, paper-feed rollers 42 that feed transfer papers from the paper-feed cassettes 44, separation rollers 45 that separate the fed transfer papers and send each transfer paper to a paper feed path 46, conveying rollers 47 that convey each transfer paper to an intra-printer-unit paper feed path 48 of the printer unit 100, and the like.

The copier 500 of the embodiment is allowed to perform manual paper feed in addition to paper feed using the paper feed unit 200, and includes on the side surface thereof a bypass tray 51 for the manual paper feed, and a bypass separation roller 52 for separating transfer papers on the bypass tray 51 one by one to convey each transfer paper to a bypass paper feed path 53.

A registration roller 49 is arranged such that each transfer paper comes into contact therewith when transfer papers placed on the paper-feed cassettes 44 or the bypass tray 51 are conveyed. The registration roller 49 discharges only one transfer paper by one rotation, and conveys the transfer paper to the secondary transfer nip portion located between the intermediate transfer belt 10 and the secondary transfer belt 24 of the secondary transfer device 29.

In the copier 500 of the embodiment, when a color image is to be copied, an original is set on a platen 30 of the original conveying unit 400, or an original is set on the contact glass 32 of the scanner unit 300 by opening the original conveying unit 400 and held by closing the original conveying unit 400.

When a start switch (not shown) is pressed while the original is set on the original conveying unit 400, the original is conveyed to be placed on the contact glass 32 and thereafter the scanner unit 300 is driven to move a first scanning member 33 and a second scanning member 34. When the start switch (not shown) is pressed while the original is set on the contact glass 32, the scanner unit 300 is immediately driven to move the first scanning member 33 and the second scanning member 34. The first scanning member 33 emits light by a light source and reflects reflected light from the surface of the original toward the second scanning member 34, and a mirror of the second scanning member 34 reflects the light to input the light to the read sensor 36 via an imaging lens 35, whereby the image information of the original is read.

The charging devices 4 (K, M, C, Y) uniformly charge the surfaces of the photosensitive elements 3 (K, M, C, Y), respectively, color separation is performed on the image information read by the scanner unit 300, and the exposing device 21 performs laser writing to the photosensitive elements 3 (K, M, C, Y) for respective colors. Consequently, electrostatic latent images are formed on the surfaces of the photosensitive elements 3 (K, M, C, Y) and then toner images for respective monochrome colors are formed.

Image formation for Y (yellow) is explained below as an example. In the image forming device 1Y for yellow, the exposing device 21 performs the laser writing to form an electrostatic latent image on the surface of the photosensitive element 3Y, and the developing device 5Y performs development by using yellow toner in accordance with the latent image, so that a toner image in a yellow monochrome color is formed on the photosensitive element 3Y. Similarly, monochrome toner images in respective colors are formed on the photosensitive elements 3 (C, M, K) in the image forming devices 1 (C, M, K) in order of C (cyan), M (magenta), and K (black).

In this manner, the toner images are formed on the photosensitive elements 3, and one of the four paper feed rollers (denoted by 42 and 50 in the figure) is driven to feed a transfer paper in a size corresponding to the above-mentioned image information.

At the same time, a drive motor (not shown) rotates one of the first support roller 14, the second support roller 15, and the third support roller 16 to thereby rotate the other two support rollers, so that the surface of the intermediate transfer belt 10 is moved clockwise in FIG. 2. The monochrome toner images on the photosensitive elements 3 (Y, C, M, K) are primary transferred onto the intermediate transfer belt 10 in sequence along with the movement of the surface of the intermediate transfer belt 10, so that a composite color image is formed on the intermediate transfer belt 10.

Meanwhile, in the paper feed unit 200, one of the paper-feed rollers 42 is selectively rotated to feed transfer papers from one of the paper-feed cassettes 44, corresponding one of the separation rollers 45 separates the transfer papers one by one to feed each transfer paper to the paper feed path 46, the conveying rollers 47 guide each transfer paper to the intra-printer-unit paper feed path 48 in the printer unit 100 being a main body of the copier 500, and each transfer paper is stopped by being brought into contact with the registration roller 49. When transfer papers on the bypass tray 51 are used, a bypass paper feed roller 50 is rotated to feed transfer papers on the bypass tray 51, the bypass separation roller 52 separates the transfer papers one by one to guide each transfer paper to the bypass paper feed path 53, and each transfer paper is stopped by being brought into contact with the registration roller 49.

Then, the registration roller 49 is rotated in synchronized timing with the composite color image on the intermediate transfer belt 10, so that the transfer paper is conveyed to the secondary transfer nip portion being a contact portion of the intermediate transfer belt 10 and the secondary transfer roller 22, and the color image is secondary transferred onto the transfer paper due to the effect of the transfer electric field and a contact pressure generated at the nip. As a result, the color image is recorded on the transfer paper.

The transfer paper onto which the color image has been transferred at the secondary transfer nip portion is conveyed to the fixing device 25 by the secondary transfer belt 24 of the secondary transfer device 29. In the fixing device 25, the color image is fixed to the transfer paper by applying a pressure force and heat at a fixation nip formed by the pressing roller 27 and the fixing belt 26. Subsequently, the transfer paper to which the color image has been fixed is discharged out of the apparatus by a discharge roller 56, and then stacked on the discharge tray 57. When images are formed on both sides of the transfer paper, the switching claw 55 changes a conveying direction to convey the transfer paper to the transfer-paper reversing device 28 after the color image is fixed, so that the transfer paper is reversed by the transfer-paper reversing device 28, guided to the secondary transfer nip portion again, subjected to recording of an image on the back surface thereof, and discharged onto the discharge tray 57 by the discharge roller 56.

The belt cleaning device 17 removes residual toner remained on the surface of the intermediate transfer belt 10 after the color image has been transferred onto the transfer paper at the secondary transfer nip portion, so that preparation is made for next image formation to be performed by the tandem-type image forming unit 20.

Furthermore, the photosensitive elements 3 from which the images have been transferred onto the intermediate transfer belt 10 are neutralized by a pre-cleaning neutralizing lamp 7 to be described later, and cleaned by removing the residual toner by the photosensitive-element cleaning devices 6. Thus, preparation is made for next image formation to be performed by repeating uniform charging operations by the charging devices 4. It is possible to arrange a post-cleaning neutralizing lamp (not shown) for neutralizing the photosensitive elements 3 after the photosensitive-element cleaning devices 6 remove the residual toner.

Figure 1A:
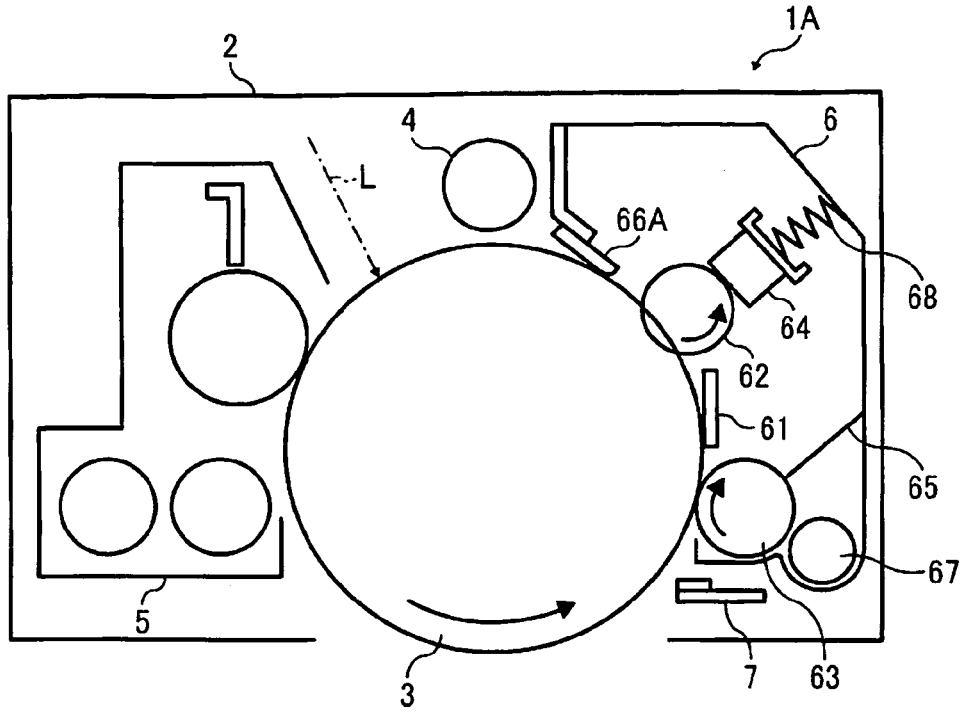
FIG. 1A is an enlarged explanatory diagram of an image forming device for black and yellow according to an embodiment.
Figure 1B:
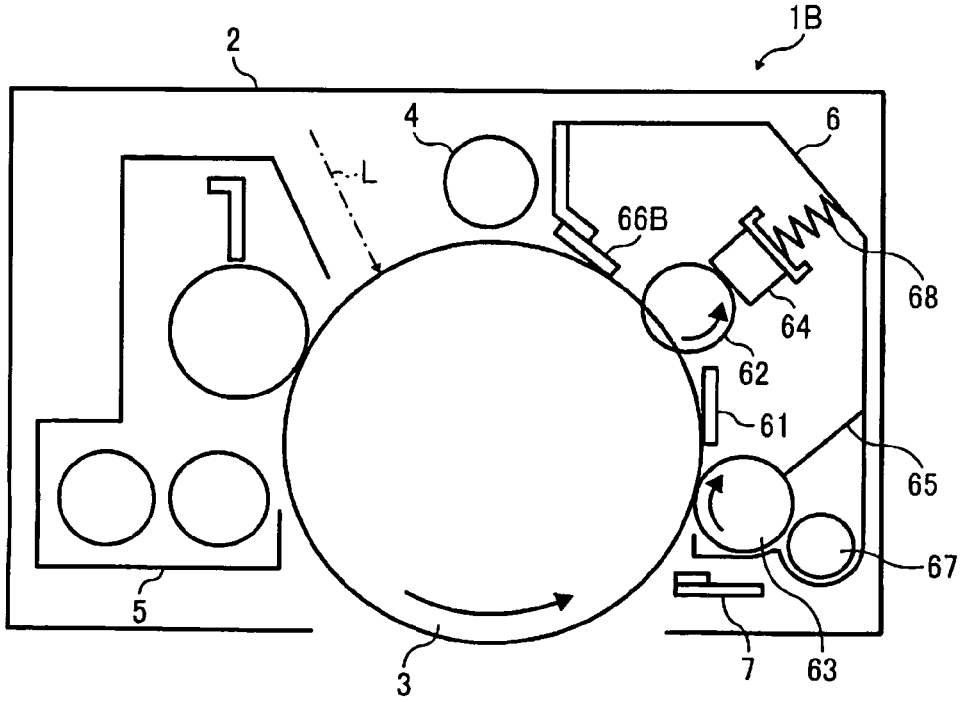
FIG. 1B is an enlarged explanatory diagram of an image forming device for other two colors according to the embodiment.

FIGS. 1A and 1B are enlarged explanatory diagrams of the image forming devices 1 according to the embodiment. More specifically, FIG. 1A is an explanatory diagram of a first image forming device 1A having a configuration used for black and yellow in common. FIG. 1B is an explanatory diagram of a second image forming device 1B having a configuration used for other two colors, i.e., magenta and cyan, in common.

As illustrated in FIGS. 1A and 1B, each image forming device 1 integrally includes the photosensitive element 3, the charging device 4 as a process means, the developing device 5, and the photosensitive-element cleaning device 6 in a unit casing 2, and is formed as a process cartridge detachably attached to the main body of the copier 500. In the embodiment, each image forming device 1 itself is configured as a replaceable process cartridge. However, each of the photosensitive element 3, the charging device 4, the developing device 5, and the photosensitive-element cleaning device 6 may be configured as a replaceable part to be separately replaced with new one.

The configuration common to all the image forming devices 1 (K, M, C, Y) is described in detail below.

Each image forming device 1 includes the photosensitive element 3 being a latent image carrier, and the charging device 4 being a charging means that charges the surface of the photosensitive element 3. Each image forming device 1 also includes the developing device 5 being a developing means that performs development by supplying toner to a latent image formed by the exposing device 21 being a latent image forming means that forms a latent image on the surface of the photosensitive element 3 charged by the charging device 4. Each image forming device 1 also includes the photosensitive-element cleaning device 6 being a toner removing means that removes residual toner remained on the surface of the photosensitive element 3 after the toner image formed by the developing device 5 has been transferred by the primary transfer roller 8 being a transferring means that transfers the toner image onto the intermediate transfer belt 10 being a transfer member. The photosensitive-element cleaning device 6 includes the pre-cleaning neutralizing lamp 7, a fur brush 63 being a rotary brush, a cleaning blade 61, an application brush 62, and a leveling blade 66 in this order from upstream to downstream in the surface movement direction of the photosensitive element 3. In the photosensitive-element cleaning device 6, the fur brush 63 and the cleaning blade 61 constitute the toner removing means. Furthermore, the lubricant supply mechanism is formed with the application brush 62 such that solid zinc stearate 64 held by a bracket is pressed to the application brush 62 by a lubricant pressing spring 68.

The pre-cleaning neutralizing lamp 7 neutralizes the surface of the photosensitive element 3 from which the toner image has been transferred onto the intermediate transfer belt 10 at the primary transfer portion where the photosensitive element 3 and the primary transfer roller 8 face each other, and the fur brush 63 causes the residual toner to be scattered. Accordingly, the toner can easily be removed by the cleaning blade 61 located downstream of the photosensitive element 3 in the surface movement direction. The toner attached to the fur brush 63 is flicked by a flicker 65, and the flicked toner is conveyed out of the photosensitive-element cleaning device 6 by a conveying screw 67.

The fur brush 63 rotates in a forward direction as indicated by arrows of FIGS. 1A and 1B with respect to the surface movement direction of the photosensitive element 3. The cleaning blade 61 is fixed to a holder (not shown) that is rotatably supported, and is supported so as to come into contact with the surface of the photosensitive element 3 in a counter direction with respect to the surface movement direction of the photosensitive element 3. The cleaning blade 61 removes the toner by being brought into pressure contact with the photosensitive element 3 by a pressing spring (not shown).

The application brush 62 applies the zinc stearate being lubricant to the surface of the photosensitive element 3 from which the toner has been removed by the cleaning blade 61. The zinc stearate is applied such that the lubricant pressing spring 68 presses the solid zinc stearate 64 held by the bracket to the application brush 62, so that the application brush 62 scrapes off the zinc stearate 64 and applies the zinc stearate 64 to the surface of the photosensitive element 3.

The application brush 62 is rotated in the counter direction with respect to the surface movement direction of the photosensitive element 3. The lubricant that has been scraped off from the zinc stearate 64 and applied to the surface of the photosensitive element 3 by the application brush 62 is densely spread on the photosensitive element 3 by the fixed-pressure type leveling blade 66 that is supported so as to come into contact with the surface of the photosensitive element 3 in the counter direction with respect to the surface movement direction of the photosensitive element 3.

In this manner, each image forming device 1 removes the residual toner from the photosensitive element 3, applies the lubricant, and makes preparation for next image formation to be started from the uniform charging by the charging device 4.

In the image forming devices 1 (K, M, C, Y) of the embodiment, the amount of scraping of the zinc stearate 64 by the application brush 62 is set to be in a range from 120 mg/km to 150 mg/km with respect to a movement distance of the photosensitive elements 3. Furthermore, the leveling blade 66 is set such that a rubber hardness is 68°, a plate thickness is 1.5 mm, a protruding amount is 6 mm, an initial contact angle is 9.5°, and an eat amount is 0.65 mm. In the embodiment, the zinc stearate 64 is used as a solid lubricant. It is possible to use a mixture of zinc stearate of 76%, boron nitride of 19%, and alumina of 5% as the solid lubricant. When such a solid lubricant is used, the amount of scraping is set to be in a range from 200 mg/km to 250 mg/km with respect to the movement distance of the photosensitive elements 3.

Regarding blade burr, it is known that the blade burr is highly likely to occur against the initial contact angle. As for the setting condition of the leveling blade 66 as described above, when the initial contact angle is set to around 20° for example as set in general cleaning blades, the blade burr occurs, which means that this condition is not applicable. Furthermore, in each image forming device 1 (K, M, C, Y) of the embodiment, a boundary value of the initial contact angle that may cause the blade burr is in a range from 11° to 13°. In this manner, in order to prevent the blade burr in each image forming device 1 (K, M, C, Y) of the embodiment, it is necessary to set, as the condition setting, the initial contact angle to be a shallower angle than an angle employed in conventional configurations.

In the copier 500 of the embodiment, as illustrated in FIG. 2, the image forming device 1 located on the leftmost side closest to the fixing device 25 among the four image forming devices 1 (K, M, C, Y) functions as the image forming device 1Y for yellow, and the image forming devices 1 (C, M, K) for cyan, magenta, and black are arranged in this order from the right side of the image forming device 1Y. In the copier 500 of the embodiment, a temperature near the leveling blade 66 at the time of image formation sometimes exceeds 40° C. in the image forming device 1Y, and remains below 40° C. in each of the image forming devices 1 (C, M, K).

Figure 3A:
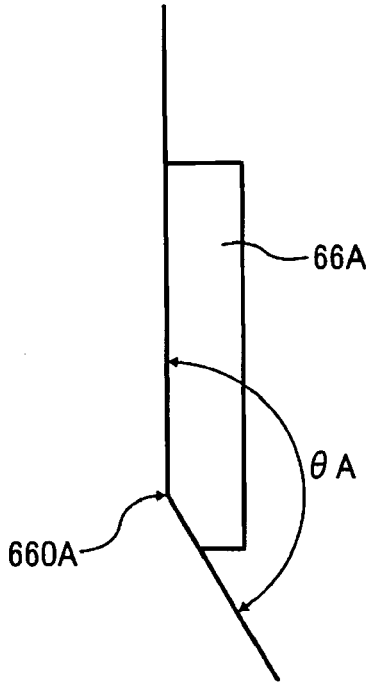
FIG. 3A is an enlarged explanatory diagram of a leveling blade included in the image forming device for black and yellow according to the embodiment.
Figure 3B:
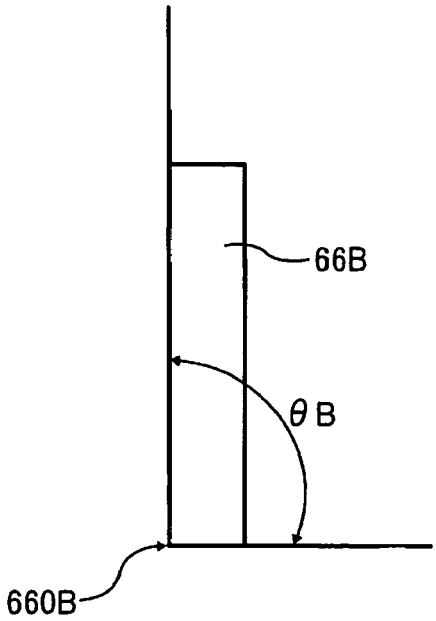
FIG. 3B is an enlarged explanatory diagram of a leveling blade included in the image forming device for the other two colors according to the embodiment.

FIGS. 3A and 3B are enlarged explanatory diagrams of the leveling blade 66 included in the image forming device 1 of the embodiment. More specifically, FIG. 3A is an explanatory diagram of a leveling blade 66A included in the first image forming device 1A having the configuration used for black and yellow in common. FIG. 3B is an explanatory diagram of a leveling blade 66B included in the second image forming device 1B having the configuration used for magenta and cyan in common.

As illustrated in FIGS. 1A, 1B, 3A, and 3B, the shape of the leveling blade 66 is different between the first image forming device 1A having the configuration used for black and yellow in common and the second image forming device 1B having the configuration used for magenta and cyan in common.

As the leveling blade 66 included in the image forming device 1Y, which is arranged at a position closest to the fixing device 25 among the four image forming devices 1 (K, M, C, Y), and the leveling blade 66 included in the image forming device 1K, which is provided for black that is most frequently used by a user, an obtuse-angle blade is used, in which a first blade corner portion angle θA between two planes forming a first used ridge portion 660A is set to 130° as in the leveling blade 66A illustrated in FIGS. 1A and 3A.

Furthermore, as the leveling blades 66 included in the image forming device 1C for cyan and the image forming device 1M for magenta, which are the other two image forming devices 1, a right-angle blade is used, in which a second blade corner portion angle θB between two planes forming a second used ridge portion 660B is set to 90° as in the leveling blade 66B illustrated in FIGS. 1B and 3B.

The obtuse-angle blade is able to improve the rigidity of a blade edge around a used ridge portion 660 and lengthen the lifetime of the blade compared to the right-angle blade. Furthermore, the obtuse-angle blade is able to prevent the blade edge around the used ridge portion 660 from largely extending due to increase in a temperature compared to the right-angle blade, so that occurrence of blade crack can be reduced. With the leveling blade 66 used in the embodiment (made of urethane rubber with a hardness of 68° and a rebound elasticity of 23% at a temperature of 10° C.), when the temperature near the leveling blade 66 exceeds 42° C. at the time of image formation, the blade crack frequently occurs. Therefore, in the copier 500 of the embodiment, the obtuse-angle blade configured as the leveling blade 66A of the first image forming device 1A illustrated in FIG. 1A is used as the leveling blade 66 in the image forming device 1Y for yellow, in which the temperature near the leveling blade 66 may exceed 40° C. at the time of image formation.

Consequently, it is possible to suppress abrasion that occurs on the leveling blade 66 in the image forming device 1Y for yellow over time, while this leveling blade 66 is otherwise easily worn away over time due to decrease in the hardness of a material of the leveling blade 66 when the temperature is increased.

When the temperature near the leveling blade 66 increases, not only is the hardness of the leveling blade 66 decreased, but also the rebound elasticity of the leveling blade 66 is increased, so that Young's module is decreased. Therefore, even urethane rubber having relatively high rigidity among rubbers is easily deformable like soft rubber. If the leveling blade 66 is easily deformable, the leveling blade 66 that comes into contact with the photosensitive elements 3 in the counter direction with respect to the surface movement direction of the photosensitive elements 3 is easily burred. To deal with this problem, by using the obtuse-angle blade as the leveling blade 66 in the image forming device 1Y in which the temperature near the leveling blade 66 is to be increased, it is possible to improve the rigidity of the blade edge around the used ridge portion 660, so that it is possible to prevent the leveling blade 66 from being burred.

Furthermore, considering the lifetime of the leveling blade 66 that depends on the abrasion, because image formation using black toner is frequently performed according to usage of users, if the lifetime of the image forming device 1K for black is lengthened, the overall cost for the image forming device 1K for black can be reduced even allowing for the increased process cost for use of the obtuse-angle blade. Therefore, in the copier 500 of the embodiment, the obtuse-angle blade configured as the leveling blade 66A of the first image forming device 1A illustrated in FIG. 1A is used as the leveling blade 66 in the image forming device 1K for black, which is more frequently used than the other image forming devices 1 (M, C, Y).

Consequently, it is possible to suppress abrasion that occurs on the leveling blade 66 of the image forming device 1K for black overtime, while this leveling blade 66 is otherwise easily worn away over time because it is more frequently used than those of the other image forming devices 1.

To suppress the abrasion that occurs over time, it is desirable to use the obtuse-angle blade as the leveling blades 66 in all the image forming devices 1 (K, M, C, Y). However, because the process cost of the obtuse-angle blade is higher than that of the right-angle blade, the overall manufacturing costs of the copier 500 increase by increasing the number of the obtuse-angle blades. Therefore, it is desirable to apply the requisite minimum number of the obtuse-angle blades to the image forming devices 1.

Consequently, in the copier 500 of the embodiment, the right-angle blade configured as the leveling blade 66B of the second image forming device 1B illustrated in FIG. 1B is used as the leveling blades 66 in the image forming device 10 and the image forming device 1M, in which the temperature near the leveling blades 66 does not exceed 40° C. and which are not frequently used among the image forming devices 1. Because the process cost of the obtuse-angle blade is higher than that of the right-angle blade, when only the requisite minimum number of the image forming devices 1 (Y, K) are provided with obtuse-angle blades as the leveling blades 66, it is possible to suppress increase in the overall manufacturing costs of the copier 500.

In the copier 500 of the embodiment, the obtuse-angle blades are used as the leveling blade 66 in the image forming device 1Y for yellow, in which the temperature near the leveling blade 66 increases more than that of the other image forming devices 1, and as the leveling blade 66 in the image forming device 1K for black, which is more frequently used than the other image forming devices 1, and, the right-angle blades are used as the leveling blades 66 in the other image forming devices 1 (C, M). However, combination of the image forming devices using the obtuse-angle blades and the image forming devices using the right-angle blades is not limited to this example.

For example, when there is little difference between the temperature near the leveling blade 66 in the image forming device 1 located closest to the fixing device 25 among the four image forming devices 1 (K, M, C, Y) and the temperature near the leveling blades 66 in the other image forming devices 1, it is possible to apply the obtuse-angle blade to only the image forming device 1K for black.

Furthermore, when there is little difference between frequency of use of the image forming device 1K for black and the image forming devices 1 for other colors, it is possible to use the obtuse-angle blade in only the image forming device 1 located closest to the fixing device 25. Moreover, any conditions other than the temperature and the use frequency may be applied. For example, when there is the image forming device 1 having the leveling blade 66 that is more likely to be worn away over time than those of the other image forming devices 1, the obtuse-angle blade is used as this leveling blade 66, and the right-angle blade is used as the leveling blades 66 in at least one of the other image forming devices 1.

Furthermore, in the copier 500 of the embodiment, the right-angle blade, in which the blade corner portion angle between the two planes forming the used ridge portion 660 is substantially the right angle, is used in all the leveling blades 66 of the image forming devices 1 other than the image forming device 1 having the obtuse-angle blade as the leveling blade 66 among the four image forming devices 1 (K, M, C, Y). However, the leveling blade 66 of the image forming device 1 other than the image forming device 1 having the obtuse-angle blade as the leveling blade 66 is not limited to the right-angle blade. It is possible to use any blades that can level out the lubricant supplied to the photosensitive elements 3 and can be made with lower process costs than that of the obtuse-angle blade.

First Modified Example

In the copier 500 of the embodiment described above, it is explained that the obtuse-angle blades are used as the leveling blades 66 in the two image forming devices 1 (K, Y) among the four image forming devices 1 (K, M, C, Y).

In the following, as a first modified example, explanation is given of the copier 500 configured to use the obtuse-angle blade as the leveling blade 66 in only the image forming device 1 in which the temperature near the leveling blade 66 becomes highest among the four image forming devices 1 (K, M, C, Y). The copier 500 of the first modified example is different from the copier 500 of the embodiment in terms of the number of the image forming devices 1 having the obtuse-angle blades as the leveling blades 66, and the rest is identical to that of the embodiment; therefore, explanation of the common configurations is not repeated.

In the copier 500, the temperature near the leveling blade 66 of the image forming device 1Y located closest to the fixing device 25 becomes highest among the four image forming devices 1 (K, M, C, Y). Therefore, in the copier 500 of the first modified example, only the image forming device 1Y for yellow includes the obtuse-angle blade as the leveling blade 66, and is configured similarly to the first image forming device 1A of the embodiment as described above with reference to FIG. 1A. On the other hand, the image forming devices 1 (K, M, C) for other three colors include the right-angle blades as the leveling blades 66, and are configured similarly to the second image forming device 1B of the embodiment as described above with reference to FIG. 1B.

In the copier 500 of the first modified example, the temperature near the leveling blade 66 of the image forming device 1K for black is the lowest among the four image forming devices 1 (K, M, C, Y). In the copier 500, as illustrated in FIG. 2, the image forming device 1Y for yellow is located at a position where it is most likely to be affected by the heat of the fixing device 25, and the image forming device 1K for black is located at a position where it is least likely to be affected by the heat of the fixing device 25 and closer to the outside air. With this arrangement, in the copier 500, when continuous paper feed is performed in the environment with 32° C. that is in a temperature-guaranteed range of the copier, the temperature near the leveling blade 66 of the image forming device 1Y for yellow becomes more than 5° C. higher than the temperature near the leveling blade 66 of the image forming device 1K for black. In this manner, conditions, e.g., a toner color used in the image forming device 1 in which the temperature near the leveling blade 66 becomes higher than that of the other image forming devices 1, and a temperature difference between the image forming device 1 in which the temperature near the leveling blade 66 becomes highest and the image forming device 1 in which the temperature near the leveling blade 66 becomes lowest, depend on the configuration and the arrangement of the image forming apparatus.

As in the copier 500 of the first modified example, when the temperature difference between the image forming device 1 in which the temperature near the leveling blade 66 becomes highest and the image forming device 1 in which the temperature near the leveling blade 66 becomes lowest is 5° C. or more, it is desirable to use the obtuse-angle blade as the leveling blade 66 in the image forming device 1 in which the temperature near the leveling blade 66 becomes highest. The reason for this is as follows.

That is, when the temperature near the leveling blade 66 is different by 5° C. between the image forming devices 1, a value of the rebound elasticity of the leveling blade 66 is generally different by about 5% to 10%. When the rebound elasticity increases due to increase in the temperature, motion of the blade edge may be activated and rubber may easily be stretched, so that the blade may easily be worn away or cracked.

In this case, the lifetime of the image forming device 1 at the increased temperature is shortened compared to the lifetime of the other image forming devices 1. Therefore, in order to maintain the lifetime similarly to the lifetime of the other image forming devices 1, it is necessary to apply a blade that is less likely to be worn away and cracked than those of the other image forming devices 1 to the leveling blade 66 of the image forming device 1 in which the temperature near the leveling blade 66 becomes highest. In this case, when a different material is used to form the leveling blade 66 that is less likely to be worn away and cracked than those of the other image forming devices 1, or a contact condition of the leveling blade 66 and the photosensitive element 3 is changed to prevent abrasion and crack, a component cost may increase and development efficiency may decrease.

On the other hand, in the copier 500 of the first modified example, the obtuse-angle blade is used as the leveling blade 66 in only the image forming device 1Y for yellow in which the temperature near the leveling blade 66 becomes higher. In this configuration, only by modifying the shape of the blade edge of the leveling blade 66 around which the temperature increases to an obtuse-angled shape, it is possible to prevent blade abrasion and blade cracking even when the material and the contact condition of the leveling blade 66 of the image forming device 1Y for yellow are maintained the same as those of the leveling blades 66 of the other image forming devices 1.

In the copier 500 of the first modified example, the obtuse-angle blade in which the first blade corner portion angle θA is set to 130° is used as the leveling blade 66A being the leveling blade 66 of the image forming device 1Y for yellow. On the other hand, the right-angle blade in which the second blade corner portion angle θB is set to 90° is used as the leveling blade 66B being the leveling blades 66 of the image forming devices 1 (K, M, C) for the other three colors.

Furthermore, in the image forming devices 1 (K, M, C, Y) of the first modified example, the amount of scraping of the zinc stearate 64 by the application brush 62 is set to be in a range from 120 mg/km to 150 mg/km with respect to a movement distance of the photosensitive elements 3. In addition, the leveling blade 66 is set such that a rubber hardness is 68°, a plate thickness is 1.5 mm, a protruding amount is 6 mm, an initial contact angle is 9.5°, and an eat amount is 0.65 mm.

The leveling blade 66 of each image forming device 1 (K, M, C, Y) included in the copier 500 of the embodiment and the first modified example described above is brought into contact with the photosensitive element 3 in the counter direction with respect to the surface movement direction of the photosensitive element 3. However, the leveling blade 66 may be brought into contact with the photosensitive elements 3 in a trailing direction.

In the embodiment described above, explanation is given of the copier 500 configured such that the blade members, some of which included in some of the four image forming devices 1 (K, M, C, Y) are the obtuse-angle blades and the rest of which included in the rest of the image forming devices 1 are the right-angle blades, are used as the leveling blades 66 that level out the lubricant supplied to the surfaces of the photosensitive elements 3. However, the blade members, some of which included in some of the image forming devices 1 are the obtuse-angle blades and the rest of which included in the rest of the image forming devices 1 are the right-angle blades, are not limited to the leveling blades 66. For example, the copier 500 may be configured such that the obtuse-angle blade is used as the cleaning blade 61 of the image forming device 1 in a condition where the cleaning blade 61 is more likely to be worn away over time than those of the other image forming devices 1, and the right-angle blades are used as the cleaning blades 61 of the other image forming devices 1.

Second Modified Example

In the copier 500 of the embodiment and the first modified example described above, the four image forming devices 1 (K, M, C, Y) are configured to use zinc stearate as the lubricant. However, the lubricant may be changed between the image forming device 1 that uses the obtuse-angle blade as the leveling blade 66 and the other image forming devices 1 among the four image forming devices 1 (K, M, C, Y).

In the following, as a second modified example, explanation is given of the copier 500 in which the lubricant to be used is changed between the image forming devices 1 (K, Y) that use the obtuse-angle blades as the leveling blades 66 and the other image forming devices 1 (M, C) among the four image forming devices 1 (K, M, C, Y). The copier 500 of the second modified example is different from the copier 500 of the embodiment in terms of the lubricant to be used, and the rest is identical to that of the embodiment; therefore, explanation of the common configurations is not repeated.

In the copier 500 of the second modified example, a substance containing zinc stearate as hydrophobic organic compound, alumina (aluminum oxide) as inorganic microparticle, and boron nitride as inorganic lubricant is used as the lubricant by the image forming devices 1 (K, Y) including the obtuse-angle blades. This lubricant is formed as a solid lubricant by performing compression molding on powders of each material, and is used instead of the solid zinc stearate 64 of the embodiment described above. On the other hand, the image forming devices 1 (M, C) including the right-angle blades use, as the lubricant, a substance formed of only zinc stearate as hydrophobic organic compound and identical to the lubricant used by the image forming devices 1 (M, C) including the right-angle blades described above in the embodiment. This lubricant is formed as a solid lubricant by performing melt molding on zinc stearate powder.

As for the method of molding the solid lubricant, the melt molding has generally higher production efficiency than that of the compression molding, and is able to reduce costs. However, because alumina and boron nitride have extremely higher meting points than that of zinc stearate, even when zinc stearate is melted, alumina and boron nitride remain as powders in molten zinc stearate. When densities of alumina and boron nitride become disproportionate in the molten zinc stearate due to precipitation and the like, material distribution of the molded solid lubricant is biased.

In the second modified example, zinc stearate powders, alumina powders, and boron nitride powders are mixed to make the material distribution uniform to some extent, and then the powders are put in a molding machine to perform the compression molding, so that the solid lubricant is formed. Therefore, even the lubricant containing alumina and boron nitride, each of which has relatively high melting points, is to be used, it is possible to obtain a solid lubricant having uniform material distribution.

As for the solid lubricant formed of only zinc stearate, costs for it can be reduced by applying the melt molding.

The hydrophobic organic compound to be contained in the lubricant is not limited to zinc stearate. Examples of the hydrophobic organic compound include the followings: hydrocarbon classified into aliphatic saturated hydrocarbon, aliphatic unsaturated hydrocarbon, alicyclic saturated hydrocarbon, alicyclic unsaturated hydrocarbon, and aromatic hydrocarbon; fluorinated resin and fluorinated wax such as polytetrafluoroethylene (PTFE), polyperfluoro alkoxy ethylene (PFA), fluorinated ethylene propylene (FEP), polyvinylidene Fluoride (PVdF), and ethylene tetrafluoroethylene copolymer (ETFE); and silicone resin and silicone wax such as poly methyl silicone and poly methyl phenyl silicone.

Examples of representative fatty acid for obtaining fatty acid metal salt such as zinc stearate as described above and stable hydrophobic metal salt include the followings: caproic acid, caprylic acid, enanthylic acid, pelargonic acid, undecylic acid, lauric acid, tridecoic acid, myristic acid, palmitic acid, margarine acid, stearic acid, nonadecaoic acid, arachidic acid, behenic acid, stillingic acid, palmitoleic acid, oleic acid, ricinoleic acid, petroselinic acid, vaccenic acid, linoleic acid, linolenic acid, eleostearic acid, licanic acid, parinaric acid, gadoleic acid, arachidonic acid, cetoleic acid; and arbitrary mixtures of above substances.

Examples of representative stable metal salt of fatty acid include the followings: barium stearate, lead stearate, iron stearate, nickel stearate, cobalt stearate, copper stearate, strontium stearate, calcium stearate, cadmium stearate, magnesium stearate, zinc stearate, zinc oleate, magnesium oleate, iron oleate, cobalt oleate, copper oleate, lead oleate, manganese oleate, zinc palmitate, cobalt palmitate, lead palmitate, manganese palmitate, aluminum palmitate, calcium palmitate, lead caprylate, lead caprate, zinc linolenate, cobalt linolenate, calcium linolenate, zinc ricinoleate, cadmium ricinoleate; and arbitrary mixtures of above substances.

Applicable fatty acid and metal salt are not limited to the examples described above.

Inorganic lubricant means a substance that is cleaved to be lubricated or that causes internal sliding in itself. Examples of the inorganic lubricant to be contained in the lubricant include mica, boron nitride, molybdenum disulfide, tungsten disulfide, talc, kaolin, montmorillonite, calcium fluoride, and graphite. However, applicable inorganic lubricant is not limited to the above examples. For example, because boron nitride is structured such that hexagonal mesh planes containing atoms that are strongly bound together are layered at wide intervals while the layers are held together by weak Van der Waals forces, boron nitride is easily cleaved to be lubricated between the layers.

On the other hand, the inorganic microparticle means a particle that is stuck between objects so as to function as a roller, but that does not cause internal sliding and cleavage in itself. Examples of the inorganic microparticle to be contained in the lubricant include silica, stannous oxide, zinc oxide, titanium oxide, alumina, zirconium oxide, indium oxide, antimony oxide, bismuth oxide, calcium oxide, metal oxide such as stannous oxide doped with antimony and indium oxide doped with stannum, metal fluoride such as stannous fluoride, calcium fluoride, and aluminum fluoride, and potassium titanate. However, applicable inorganic microparticle is not limited to the above examples. Furthermore, arbitrary mixtures of the above substances may also be used.

Listed below is the percentage of each material contained in the lubricant used by the image forming devices 1 (K, Y) having the obtuse-angle blades of the second modified example.

Zinc stearate (Wako Pure Chemical Industries, Ltd.): 70 [weight percent]

Alumina (particle diameter: 3 μm): 10 [weight percent]

Boron nitride (Shiseido, Co., Ltd.): 20 [weight percent]

The lubricant used by the image forming devices 1 (K, Y), which include the leveling blades 66 of the second modified example that are easily worn away over time, is able to prevent toner slip-through, pollution of a charging member, and filming of the image carriers because of the following reasons.

That is, an electrophotographic image carrier is coated with an image-carrier protecting agent such as lubricant in order to protect the image carrier from hazards of charging and cleaning. However, the lubricity of generally-used fatty acid metal salt decreases due to the effect of the charging, so that toner may slip through the contact portion of the cleaning member, resulting in a cleaning failure. Furthermore, fatty acid metal salt itself is caused to fly to get attached to the charging member, so that the charging member may be polluted.

To solve the above problems, it is possible to subserve the lubricant and prevent the toner slip-through by doping inorganic lubricant. Furthermore, the lubricity can be increased, so that the amount of fatty acid metal salt that slips through can be reduced, reducing the amount of the fatty acid metal salt that flies to get attached to the charging member. However, if only the inorganic lubricant is doped, because its lubricity is extremely high, it is difficult to remove the lubricant from the surface of the image carrier, which may cause the filming of the image carrier.

To deal with the filming, if inorganic microparticle is doped in addition to the inorganic lubricant, it is possible to remove the inorganic lubricant by the inorganic microparticle. However, if a solid lubricant made of only the inorganic lubricant and the inorganic microparticle is used, the inorganic microparticle can hardly function to remove the filming of the inorganic lubricant on the surface of the image carrier. This is because the inorganic lubricant can be removed only when hydrophobic organic compound such as fatty acid metal salt takes in the inorganic microparticle.

By using the lubricant containing inorganic lubricant, inorganic microparticle, and hydrophobic organic compound in the image forming devices 1 (K, Y) for black and yellow in which the leveling blades 66 are more easily worn away over time than those of the other image forming devices 1 (M, C) among a plurality of image forming devices, it is possible to prevent abrasion that occurs on the leveling blades 66 over time.

On the other hand, by using a solid lubricant made of only hydrophobic organic compound and formed by melt molding is used in the other image forming devices 1 (M, C) in which the leveling blades 66 are less likely to be worn away over time than those of the image forming devices 1 (K, Y), it is possible to reduces costs.

As described above, the copier 500 being the image forming apparatus of the embodiment includes the four image forming devices 1, each of which includes the photosensitive element 3 being an image carrier that carries a toner image and the surface of which is moved; the photosensitive-element cleaning device 6 being a toner removing means that removes residual toner remained on the surface of the photosensitive element 3 from which a toner image has been transferred by the primary transfer roller 8 being a transferring means that transfers a toner image onto the intermediate transfer belt 10 being a transfer member; the application brush 62 forming the lubricant supply mechanism that supplies lubricant to the surface of the photosensitive element 3 from which the residual toner has been removed by the photosensitive-element cleaning device 6; and the leveling blade 66 being a lubricant leveling blade in which the used ridge portion 660 is brought into contact with the surface of the photosensitive element 3 such that the used ridge portion 660 intersects with the surface movement direction of the photosensitive element 3 so as to level out the lubricant supplied to the surface of the photosensitive element 3. The first image forming device 1A, which is an image forming device in which the leveling blade 66 is more easily worn away over time than that of the second image forming device 1B being the other image forming device among the four image forming devices 1 (K, M, C, Y), includes an obtuse-angle blade as the leveling blade 66A in which the first blade corner portion angle θA formed between two planes, one of which faces the surface of the photosensitive element 3 on the upstream side and the other of which faces the surface of the photosensitive element 3 on the downstream side in the surface movement direction of the surface of the photosensitive element 3 (K, M, C, Y) across the first used ridge portion 660A, is set to an obtuse angle. Furthermore, the second image forming device 1B, which is an image forming device other than the first image forming device 1A having the obtuse-angle blade among the four image forming devices 1 (K, M, C, Y), includes a right-angle blade as the leveling blade 66B in which the second blade corner portion angle θB between two planes forming the second used ridge portion 660B is set to a substantially right angle. Thus, the obtuse-angle blades is used as the leveling blade 66A in the first image forming device 1A in which the leveling blade 66A is easily worn away over time, and the right-angle blade is used as the leveling blade 66B in the second image forming device 1B being the other image forming devices. Therefore, it is possible to maintain the functions of the leveling blade 66A of the first image forming device 1A over time while the leveling blade 66A is otherwise easily worn away, and it is also possible to prevent increase in the overall manufacturing costs of the copier 500.

Furthermore, in the copier 500, only the image forming device 1Y for yellow, in which the temperature near the leveling blade 66 becomes higher than that of the other image forming devices 1 (K, M, C) among the four image forming devices 1 (K, M, C, Y), and the image forming device 1K for black, in which black toner is used for forming a toner image, include the obtuse-angle blades as the leveling blades 66. Therefore, it is possible to prevent the abrasion that occurs on the leveling blade 66 over time in the image forming device 1Y for yellow, in which the leveling blade 66 is easily worn away over time because of decrease in the hardness of the material forming the leveling blade 66 due to the increase in the temperature. Furthermore, it is possible to prevent the abrasion that occurs on the leveling blade 66 over time in the image forming device 1K for black, in which the leveling blade 66 is easily worn away over time due to frequent use. Moreover, the right-angle blade configured as the leveling blade 66B of the second image forming device 1B illustrated in FIG. 1B is used in the image forming device 1C for cyan and the image forming device 1M for magenta, in each of which the temperature near the leveling blade 66 does not exceed 40° C. and which is not frequently used. Therefore, although the process cost of the obtuse-angle blade is higher than that of the right-angle blade, because the obtuse-angle blade is used as the leveling blade 66 in the requisite minimum number of the image forming devices 1 (Y, K), it is possible to prevent increase in the overall manufacturing costs of the copier 500.

Furthermore, in the copier 500 of the embodiment, the temperature near the leveling blade 66 of the image forming device 1Y for yellow, in which the temperature near the leveling blade 66 becomes higher than that of the other image forming devices 1 (K, M, C), exceeds 40° C. at the time of image formation, and the temperature near the leveling blade 66 of each image forming device 1 (K, M, C) does not exceed 40° C. In this configuration, even when the leveling blade 66 that is often cracked when the temperature near the leveling blade 66 exceeds 42° C. is used, it is possible to prevent abrasion of the leveling blade 66 over time in the image forming device 1Y for yellow.

Moreover, in the copier 500 of the embodiment, the first blade corner portion angle θA formed between two planes, one of which faces the surface of the photosensitive element 3 on the upstream side and the other of which faces the surface of the photosensitive element 3 on the downstream side in the surface movement direction of the surface of the photosensitive element 3 across the first used ridge portion 660A of the leveling blade 66A being the obtuse-angle blade, is set to be larger than 90° and smaller than 140°. In the configuration using the obtuse angle, the first blade corner portion angle θA is larger than 90°. Furthermore, when the first blade corner portion angle θA is set to equal to or larger than 140°, it is difficult to make a uniform contact of the blade edge forming the first used ridge portion 660A, so that it is difficult to obtain necessary contact pressure. This is because the blade edge has roughness when viewed microscopically, and, in order to make the contact of the blade edge so as to fill and eliminate the space caused by the roughness, more force is necessary as the angle of the first blade corner portion angle θA is increased. When the leveling blade 66 is brought into contact with the photosensitive element 3 with the increased force, and if it is assumed that the leveling blade 66 is not worn away, the photosensitive element 3 may easily be worn away and can hardly be handled easily. When the first blade corner portion angle θA is set to about 140°, it is possible to bring the leveling blade 66 into contact with the photosensitive element 3 without any problems. Furthermore, in terms of cutting accuracy in manufacturing, when the first blade corner portion angle θA is increased, a contact area between a cutting tool and a rubber plate as a material of the leveling blade 66 increases, so that the cutting accuracy may be reduced. To deal with this problem, when the first blade corner portion angle θA is set to about 140°, a cutting process can be performed without any problems.

More specifically, it is desirable to set the first blade corner portion angle θA to equal to or larger than 95°. When the first blade corner portion angle θA is smaller than 95°, advantages of use of the obtuse angle to prevent the abrasion are reduced.

Furthermore, in the copier 500 of the embodiment, the leveling blades 66 included in the four image forming devices 1 (K, M, C, Y) are brought into contact with the surfaces of the photosensitive elements 3 in the counter direction with respect to the surface movement direction of the photosensitive elements 3. In the method of contact in the counter direction, it is possible to bring the leveling blades 66 into contact with the surfaces of the photosensitive elements 3 with higher contact pressure than in the method of contact in the trailing direction.

Furthermore, in the copier 500 of the embodiment, each of the four image forming devices 1 (K, M, C, Y) is the image forming device that includes the photosensitive element 3 being a latent image carrier as an image carrier; the charging device 4 being the charging means that charges the surface of the photosensitive element 3; the developing device 5 being the developing means that forms a toner image by supplying toner to the latent image formed by the exposing device 21 being the latent-image forming means that forms a latent image on the surface of the photosensitive element 3 charged by the charging device 4; the photosensitive-element cleaning device 6 that removes residual toner remained on the photosensitive element 3 from which the toner image has been transferred by the primary transfer roller 8 being the transferring means that transfers the toner image formed by the developing device 5 onto the intermediate transfer belt 10 being the transfer member; the application brush 62; and the leveling blade 66.

Moreover, in the copier 500 of the embodiment, each image forming device 1 is formed as a process cartridge detachably attached to the main body of the copier 500, so that the replaceability of the image forming devices 1 can be improved.

In the copier 500 in which frequency of use of the image forming device 1K for black is not different from that of the image forming devices for other colors unlike the copier 500 of the embodiment, it is possible to use the obtuse-angle blade as the leveling blade 66 in only the image forming device 1Y for yellow, in which the temperature near the leveling blade 66 becomes higher than that of the other image forming devices 1 (K, M, C) among the four image forming devices 1 (K, M, C, Y).

Moreover, in the copier 500 in which the temperature near the leveling blade 66 of the image forming device 1 located closest to the fixing device 25 among the four image forming devices 1 (K, M, C, Y) is not different from the temperature near the leveling blades 66 of the other image forming devices 1 unlike the copier 500 of the embodiment, it is possible to use the obtuse-angle blade as the leveling blade 66 in only the image forming device 1K for black, in which black toner is used for forming a toner image among the four image forming devices 1 (K, M, C, Y).

Furthermore, in the copier 500 of the first modified example, the obtuse-angle blade is used as the leveling blade 66 in only the image forming device 1Y for yellow, in which the temperature near the leveling blade 66 becomes highest (most different from the lowest temperature that occurs in the image forming device 1K for black), among the four image forming devices 1 (K, M, C, Y). With this configuration, it is possible to prevent the leveling blade 66, which is located in a high-temperature area in which the rebound elasticity is increased and blade cracking is likely to occur, from easily cracking and causing defects in images.

Moreover, in the copier 500 of the first modified example, the temperature near the leveling blade 66 of the image forming device 1Y for yellow, in which the obtuse-angle blade is used as the leveling blade 66, is more than 5° C. higher than the temperature near the leveling blade 66 of the image forming device 1K for black, in which the temperature near the leveling blade 66 becomes lowest. When the temperature near the leveling blade 66 is different by more than 5° C. between the image forming devices 1, the rebound elasticity of the leveling blade 66 is different by about 5% to 10%, so that the motion of the blade edge may be activated and the rubber may easily be stretched, resulting in easily causing the blade abrasion and the blade cracking. However, because the obtuse-angle blade is used as the leveling blade 66 in the image forming device 1Y for yellow in which the temperature becomes higher than that of the other leveling blades 66, it is possible to prevent occurrence of the blade abrasion and the blade cracking.

Furthermore, in the copier 500 of the first modified example, a blade member made of an identical rubber material is used as the leveling blade 66 as the obtuse-angle blade of the image forming device 1Y for yellow and the leveling blades 66 as the right-angle blades of the image forming devices 1 (K, M, C) for the other three colors. Therefore, it is possible to reduce manufacturing costs and design loads.

Moreover, in the copier 500 of the first modified example, the contact condition for bringing the leveling blades 66 into contact with the surfaces of the photosensitive elements 3 is set to be identical for the leveling blade 66 of the image forming device 1Y for yellow, in which the obtuse-angle blade is used as the leveling blade 66, and the leveling blades 66 of the image forming devices 1 (K, M, C) for the other three colors, in which the right-angle blades are used as the leveling blades 66. Therefore, it is possible to reduce design costs.

Furthermore, because boron nitride is contained in the lubricant, it is possible to increase the resistance to electrical and mechanical stress in the charging process and the cleaning process performed on the surface of the photosensitive elements 3 being the image carries. Therefore, it is possible to lengthen the lifetime of the photosensitive elements 3 being the image carriers and the cleaning blades 61 being the cleaning members. It is also possible to stabilize the image quality.

Moreover, in the copier 500 of the second modified example, the lubricant used by the image forming devices 1 (K, Y) having the obtuse-angle blades as the leveling blades 66 contains hydrophobic organic compound, inorganic microparticle, and inorganic lubricant. Therefore, in the image forming devices 1 (K, Y) for black and yellow, in which the leveling blades 66 are more easily worn away over time than those of the other, image forming devices 1 (M, C), it is possible to prevent the abrasion of the leveling blade 66 over time. If the lubricant containing hydrophobic organic compound, inorganic microparticle, and inorganic lubricant is used in each image forming device 1, manufacturing costs for the lubricant made of a plurality of materials are increased by the number of the image forming devices. Therefore, it is desirable to decrease the number of the image forming devices 1 that use a solid lubricant being the lubricant containing hydrophobic organic compound, inorganic microparticle, and inorganic lubricant as much as possible. In the copier 500 of the second modified example, the lubricant used by the image forming devices 1 (M, C) having the right-angle blades as the leveling blades 66 contains at least inorganic lubricant and does not contain hydrophobic organic compound and inorganic microparticle. Therefore, it is possible to prevent increase in the overall manufacturing costs of the image forming apparatus.

Furthermore, in the copier 500 of the second modified example, the lubricant used by the image forming devices 1 (K, Y) having the obtuse-angle blades as the leveling blades 66 is molded as a solid lubricant by compressing powders of hydrophobic organic compound, inorganic microparticle, and inorganic lubricant as materials. Therefore, even when the lubricant is made of materials having different melting points, it is possible to obtain a solid lubricant with uniform material distribution. Moreover, the lubricant used by the image forming devices 1 (M, C) having the right-angle blades as the leveling blades 66 is molded as a solid lubricant by melting zinc stearate as a hydrophobic organic compound material. When only zinc stearate is used, melt molding can be applied, and, when the melt molding is applied, mass production can easily be carried out. Therefore, production costs can be decreased. As a result, it is possible to prevent increase in the overall manufacturing costs of the image forming apparatus.

Moreover, in the copier 500 of the second modified example, the lubricant used by the image forming devices 1 (K, Y) having the obtuse-angle blades contains zinc stearate being fatty acid metal salt as hydrophobic organic compound, alumina as inorganic microparticle, and boron nitride as inorganic lubricant. Therefore, it is possible to obtain the lubricant that can prevent the abrasion of the leveling blades 66 over time.

In an image forming apparatus having a plurality of image forming devices, the degree of abrasion of blade members depends of the image forming devices even when the blade members are started to be used at the same time. For example, in an image forming apparatus including a heating-type fixing device as a fixing device, environmental temperature of the blade member of an image forming device closest to the fixing device becomes higher than that of the blade members of the other image forming devices. When the temperature increases, the hardness of a material forming the blade member decreases, so that the blade member is more easily worn away over time than those of the image forming devices in which the environmental temperature of the blade members is low. Furthermore, in case of a full-color image forming apparatus, in an image forming device that forms a toner image with black toner that is more frequently used than other colors, the blade member is more easily worn away than those of the image forming devices for the other colors because a surface movement distance of an image carrier for black is long. Therefore, by applying different configurations to the blade members between the image forming device in which the blade member is easily worn away over time and the other image forming devices, it is possible to maintain the functions of the blade members over time, and at the same time, it is possible to prevent increase in overall manufacturing costs of the image forming apparatus.

According an aspect of to the present invention, the obtuse-angle blade is used as the lubricant leveling blade in the image forming device in which the lubricant leveling blade is easily worn away over time, and the right-angle blade is used as the lubricant leveling blade in other image forming devices. Therefore, it is possible to maintain the functions of the lubricant leveling blade over time, and prevent increase in the overall manufacturing costs of the image forming apparatus.

Furthermore, according to another aspect of the present invention, the obtuse-angle blade is used in the image forming device in which the blade member is easily worn away over time, and the right-angle blade is used in other image forming devices. Therefore, it is possible to maintain the functions of the blade member over time, and prevent increase in the overall manufacturing costs of the image forming apparatus.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus, comprising a plurality of image forming devices each including:

an image carrier that carries a toner image and a surface of which is moved;

a toner removing unit that removes residual toner remained on the surface of the image carrier after the toner image is transferred to a transfer member by a transferring unit;

a lubricant supply mechanism that supplies lubricant to the surface of the image carrier after the toner removing unit removes the residual toner; and a lubricant leveling blade that is arranged such that a ridge portion of the lubricant leveling blade comes into contact with the surface of the image carrier so that the ridge portion intersects with a surface movement direction of the surface of the image carrier, and that levels out the lubricant supplied to the surface of the image carrier, wherein an image forming device in which the lubricant leveling blade is more easily worn away over time than the lubricant leveling blades of the other image forming devices among the plurality of image forming devices includes, as the lubricant leveling blade, an obtuse-angle blade in which a blade corner portion angle formed by two planes, one of which faces the surface of the image carrier on an upstream side and the other of which faces the surface of the image carrier on a downstream side in a surface movement direction of the surface of the image carrier across the ridge portion, is set to an obtuse-angle, and each image forming device other than the image forming device having the obtuse-angle blade includes, as the lubricant leveling blade, a right-angle blade in which the blade corner portion angle formed by two planes forming the ridge portion is set to a substantially right angle.

2. The image forming apparatus according to claim 1, wherein only an image forming device in which temperature near the lubricant leveling blade becomes higher than temperature in the other image forming devices among the plurality of image forming devices includes the obtuse-angle blade as the lubricant leveling blade.

3. The image forming apparatus according to claim 1, wherein only an image forming device using black toner for forming a toner image among the plurality of image forming devices includes the obtuse-angle blade as the lubricant leveling blade.

4. The image forming apparatus according to claim 1, wherein an image forming device, in which temperature near the lubricant leveling blade becomes higher than temperature in the other image forming devices, and an image forming device, in which black toner is used for forming a toner image, among the plurality of image forming devices respectively include the obtuse-angle blades as the lubricant leveling blades.

5. The image forming apparatus according to claim 2, wherein the temperature near the lubricant leveling blade in the image forming device in which the temperature near the lubricant leveling blade becomes higher than temperature in the other image forming devices becomes 40° C. or more.

6. The image forming apparatus according to claim 4, wherein the temperature near the lubricant leveling blade in the image forming device in which the temperature near the lubricant leveling blade becomes higher than temperature in the other image forming devices becomes 40° C. or more.

7. The image forming apparatus according to claim 1, wherein only an image forming device in which temperature near the lubricant leveling blade becomes highest among the plurality of image forming devices includes the obtuse-angle blade as the lubricant leveling blade.

8. The image forming apparatus according to claim 7, wherein the temperature near the lubricant leveling blade in the image forming device having the obtuse-angle blade as the lubricant leveling blade is 5° C. or more higher than temperature near the lubricant leveling blade in an image forming device in which the temperature near the lubricant leveling blade becomes lowest.

9. The image forming apparatus according to claim 1, wherein the obtuse-angle blade and the right-angle blade are formed by using a blade member made of identical rubber material.

10. The image forming apparatus according to claim 1, wherein a contact condition for bringing the lubricant leveling blade into contact with the surface of the image carrier is identical between the image forming device having the obtuse-angle blade as the lubricant leveling blade and the image forming devices having the right-angle blades as the lubricant leveling blades.

11. The image forming apparatus according to claim 1, wherein the blade corner portion angle formed between two planes, one of which faces the surface of the image carrier on the upstream side and the other of which faces the surface of the image carrier on the downstream side in the surface movement direction of the surface of the image carrier across the ridge portion of the obtuse-angle blade, is larger than 90° and smaller than 140°.

12. The image forming apparatus according to claim 1, wherein each lubricant leveling blade comes into contact with the surface of the image carrier in a counter direction with respect to the surface movement direction.

13. The image forming apparatus according to claim 1, wherein each of the image forming devices includes:

an electrostatic latent image carrier that functions as the image carrier;

a charging unit that charges a surface of the electrostatic latent image carrier;

an electrostatic latent image forming unit that forms an electrostatic latent image on the surface of the electrostatic latent image carrier charged by the charging unit;

a developing unit that supplies toner to the electrostatic latent image formed by the electrostatic latent image forming unit to thereby form a toner image;

the toner removing unit that removes residual toner remained on the surface of the electrostatic latent image carrier after the transferring unit transfers the toner image formed by the developing unit onto a transfer member; and the lubricant supply mechanism; and the lubricant leveling blade.

14. The image forming apparatus according to claim 1, wherein each of the image forming devices is a process cartridge detachably attached to a main body of the image forming apparatus.

15. The image forming apparatus according to claim 1, wherein lubricant used by the image forming device having the obtuse-angle blade as the lubricant leveling blade contains at least hydrophobic organic compound, inorganic microparticle, and inorganic lubricant.

16. The image forming apparatus according to claim 15, wherein the lubricant used by the image forming device having the obtuse-angle blade as the lubricant leveling blade is molded by compressing materials.

17. The image forming apparatus according to claim 15, wherein the hydrophobic organic compound is fatty acid metal salt, the inorganic microparticles are alumina, and the inorganic lubricant is boron nitride.

18. An image forming apparatus comprising a plurality of image forming devices each including:

an image carrier that carries a toner image and a surface of which is moved; and a blade member arranged such that a ridge portion of the blade member comes into contact with the surface of the image carrier so that the ridge portion intersects with a surface movement direction of the surface of the image carrier, wherein an image forming device in which the blade member is more easily worn away over time than the blade members of other image forming devices among the plurality of image forming devices includes, as the blade member, an obtuse-angle blade in which a blade corner portion angle formed by two planes, one of which faces the surface of the image carrier on an upstream side and the other of which faces the surface of the image carrier on a downstream side in the surface movement direction of the surface of the image carrier across the ridge portion, is set to an obtuse angle, and each image forming device other than the image forming device having the obtuse-angle blade includes, as the blade member, a right-angle blade in which the blade corner portion angle formed by two planes forming the ridge portion is set to a substantially right angle.

* * * * *